US006231296B1

(12) United States Patent
Blomgren

(10) Patent No.: US 6,231,296 B1
(45) Date of Patent: May 15, 2001

(54) DEVICE FOR DETACHABLE COUPLING OF AN IMPLEMENT TO THE OPERATING ARM OF AN EXCAVATOR

(75) Inventor: Stig Blomgren, Lindome (SE)

(73) Assignee: Accima AB, Lindome (SE)

( * ) Notice: Subject to any disclaimer, the term of this patent is extended or adjusted under 35 U.S.C. 154(b) by 0 days.

(21) Appl. No.: 09/424,077

(22) PCT Filed: May 13, 1998

(86) PCT No.: PCT/SE98/00881

§ 371 Date: Nov. 18, 1999

§ 102(e) Date: Nov. 18, 1999

(87) PCT Pub. No.: WO98/53152

PCT Pub. Date: Nov. 26, 1998

(30) Foreign Application Priority Data

May 21, 1997 (SE) ..... 9701887

(51) Int. Cl.[7] ..... E02F 3/00
(52) U.S. Cl. ..... 414/723; 37/468; 403/324
(58) Field of Search ..... 414/723; 37/468; 403/321, 322.3, 324

(56) References Cited

U.S. PATENT DOCUMENTS 5,125,788 6/1992 Stenger .

FOREIGN PATENT DOCUMENTS 0 139 652 1/1987 (EP) .

*Primary Examiner*—Donald W. Underwood
(74) *Attorney, Agent, or Firm*—Nixon & Vanderhye P.C.

(57) ABSTRACT

A device for coupling of an implement (1) to the operating arm of an excavator, comprising an operating arm attachment (25) and a locking member (50) with a hydraulic cylinder (51) and a control unit (41) for supplying the cylinder with an operating pressure, the cylinder having double pistons (57, 58) with piston rods (52, 53) forming locking wedges, wherein the pressure area of the piston is greater on the plus side for locking than on the minus side for opening, said device also comprising implement attachment with coupling members (4, 5) and locking elements (80, 81) by means of which the implement attachment is coupled to the operating-arm attachment under the influence of the locking member, which operating-arm attachment is provided with two links (26, 27) having counter-supports (39) for cooperation with counter-supports (16, 17) on the implement attachment, the locking member thus exerting pressure on the links in order to press them against the coupling member. According to the invention the cylinder is loosely mounted in openings (93, 94) in the links and stop members are arranged on the cylinder and a link to prevent rotation of the cylinder. Furthermore the control unit also pressurizes the chambers (71, 72) on said plus sides even during locking. The control unit pressurizes the chambers (73, 74) on said minus sides even when the locking wedges are moved from opening to locking position and when the locking wedges assume locking positions. A non-return valve (45) is arranged in the locking connection between the control unit and the chambers (71, 72) on said plus sides, this valve being openable to emptying of the latter chambers by means of the operating pressure.

20 Claims, 5 Drawing Sheets

DEVICE FOR DETACHABLE COUPLING OF AN IMPLEMENT TO THE OPERATING ARM OF AN EXCAVATOR

CROSS-REFERENCE TO RELATED APPLICATION

This application is a U.S. national phase of International application no. PCT/SE98/00881 filed May 13, 1998.

BACKGROUND AND SUMMARY OF THE INVENTION

The present invention relates to a device for detachable coupling of an implement and the operating arm of an excavator together, said implement having an upper side with a forward edge facing the operating arm, said device comprising an attachment member which is supported by the stick and operating cylinder of the operating arm and comprises a shaft journalled horizontally at the stick, a shaft journalled horizontally at the operating cylinder, said shafts being parallel to and arranged at a predetermined distance from each other, and a hydraulic locking member comprising a hydraulic cylinder and a control unit for supplying the hydraulic cylinder with a predetermined operating pressure via a locking connection and an opening connection, which hydraulic cylinder has double pistons with piston rods facing away from each other which can be inserted and withdrawn to opening and locking position, the free outer end parts of said piston rods having a surface sloping outwardly to form locking wedges, each of the pistons defining a rear pressure chamber that forms the plus side of the piston, and a forward pressure chamber that forms the minus side of the piston, wherein the pressure area of the piston is greater on the plus side than on the minus side, said device also comprising an attachment member supported by the implement and comprising a coupling member and locking element, by means of which coupling member and locking element the implement attachment member is arranged to be detachably coupled to the attachment member of the operating arm under the influence of said hydraulic locking member, the implement thus being pivotable about the shaft of the stick by means of said operating cylinder, the attachment member of said operating arm comprising two link arms having a counter-support facing the implement and arranged below the shaft of the operating cylinder, which implement attachment member comprises two counter-supports arranged to cooperate with the counter-support of the link arms, which locking member is arranged to exert a pressure on the link arms in order to press these directly against the coupling member thereby achieving intimate contact between opposing support surfaces.

A device, known as a quick-coupling, with hydraulic locking members of the type described above is known through EP-0 139 652, see FIG. 8. The known device lacks satisfactory locking if a fault should occur in the hydraulic system and its locking wedges are unprotected and may therefore be damaged in inoperative positions. This may result in poorer locking function which in turn may deteriorate the influence of the link arms on the coupling member so that contact between the support surfaces of said counter-supports is insufficient and play occurs between them. Neither is the known locking member easy to install. SE-B-454 192 shows a similar quick-coupling but this lacks a hydraulic locking member.

EP-0 448 788 describes a quick-coupling with a hydraulic locking member but lacks the two attachment members which are significant for the quick-coupling described in EP-0 139 652 and according to the present invention with cooperating counter-supports, and also lacks a locking member with locking wedges to transfer compressive force at said counter-supports and eliminate play at their contact surfaces. No auto-adjustment of the locking positions of the locking pistons can therefore be obtained with the known locking member since wear appears gradually on the movable surfaces. It will be understood that the problem of play at opposing movable surfaces increases with increased wear.

The object of the present invention is to eliminate the problems discussed above and provide an improved device of the type described in the introduction, with a hydraulic locking member that ensures locking even if a fault should arise in the hydraulic system, where the locking wedges are protected from external influence in inoperating positions, which is easy to install, and which is self-adjusting upon wear in the contact surfaces so that play is eliminated and efficient locking and coupling functions are ensured even after extended use.

The coupling device according to the invention is characterized in that by means of its end parts facing away from each other, the hydraulic cylinder is loosely mounted in corresponding, opposing openings in the link arms to form loose connections without locking engagement preventing axial movement of the hydraulic cylinder, cooperating stop members are arranged on the hydraulic cylinder and at least one link arm to prevent rotation of the hydraulic cylinder in said openings, the control unit is arranged to continuously supply the pressure chambers on the plus sides of the pistons with said predetermined operating pressure even when the locking wedges assume their withdrawn locking positions, the control unit is arranged to supply the pressure chambers on the minus sides of the pistons with said predetermined operating pressure even when the locking wedges are moved from opening position to locking position and when the locking wedges assume their locking positions to achieve a controlled, reduced locking action of the locking wedges corresponding to the area difference on the plus and minus sides of the pistons, and a pilot-controlled non-return valve is arranged in the locking connection between the control unit and the pressure chambers on the plus sides of the pistons, the non-return valve being openable to permit emptying of the pressure chambers on the plus sides of the pistons through the influence of said predetermined operating pressure, the non-return valve being connected via a branch connection to said opening connection for supplying said predetermined operating pressure when the locking connection is disconnected.

The invention will be described in more detail in the following, with reference to the drawings.

DETAILED DESCRIPTION OF THE DRAWINGS

Figure 1:
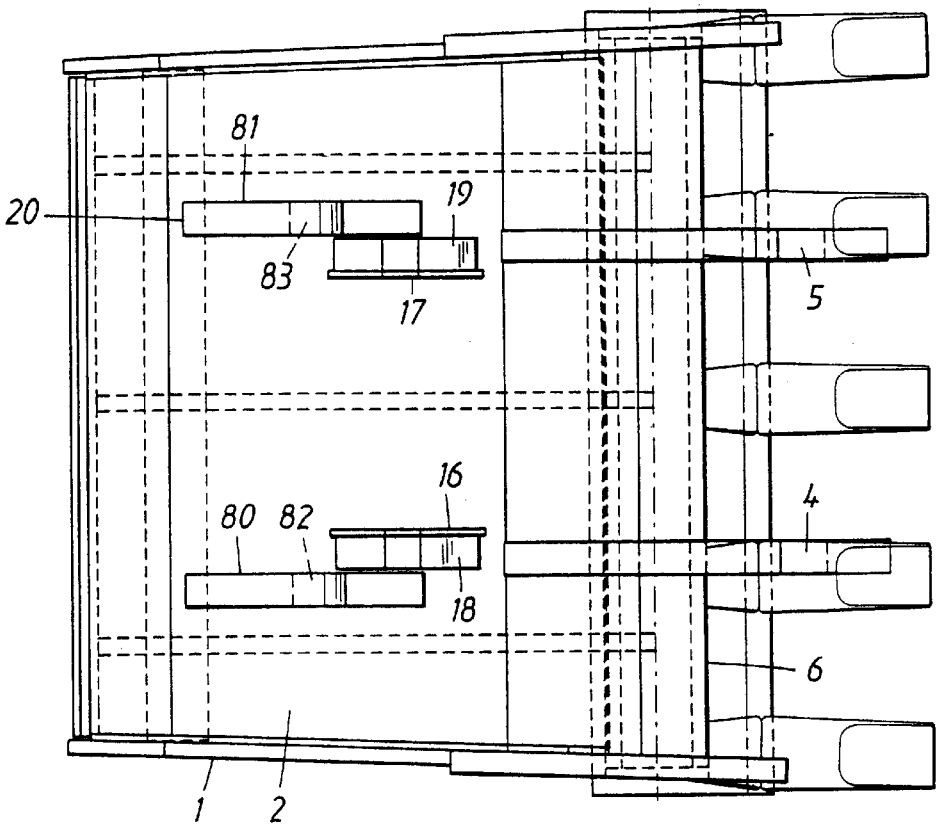
FIG. 1 shows schematically a bucket from above.

The drawings show the bucket 1 of an excavator which is provided on its upper side 2 facing away from the digging edge, with an attachment member 20 to a quick-coupling. This bucket attachment member 20 comprises a coupling member in the form of two inwardly facing hooks 4, 5, spaced from each other, which are welded to the upper side 2 at the forward edge 6 of the opening of the bucket 1. The inwardly facing hooks are provided with functional support surfaces 9, concave or semi-cylindrical in shape, with predetermined radii to achieve intimate cooperation with corresponding support surfaces on an attachment member 25 supported by the operating arm of the excavator, as will be described below. The two support surfaces 9 are aligned with each other and perpendicular to the plane of symmetry of the bucket.

The bucket attachment member 20 comprises two locking elements 80, 81 provided with openings 82, 83 aligned with each other and having inclined support surfaces 90 which slope downwardly-outwardly. The bucket attachment member 20 also comprises two heel-shaped counter-supports 16, 17 welded to the upper side 2 and arranged between the locking elements and hooks 4, 5, in the vicinity of the former. Each counter-support 16, 17 is provided with a flat, functional support surface 18, 19, these support surfaces lying in the same plane and inclining inwardly towards the hooks 4, 5 for cooperation with corresponding support surfaces 40 on the operating-arm attachment member 25, as will be explained below.

The operating arm of the excavator comprises a stick (not shown) and a hydraulic operating cylinder (not shown) arranged on its front side (facing away from the excavator). The stick supports a horizontal shaft 23 at its free end, the shaft pivotably supporting the bucket 1 and thus forming the centre of pivoting of the bucket, while said hydraulic cylinder directly or indirectly via links, supports a horizontally arranged shaft 24 lying parallel with the shaft 23 of the stick and thus situated in front of this and indirectly joined to the bucket 1 to obtain a controlled swinging movement of the bucket about the centre of the shaft 23.

Said shafts 23, 24 form parts of said attachment member 25 of the operating arm. The operating-arm attachment member 25 also comprises two parallel link arms 26, 27, each of which has a locking end part 86 and a coupling end part 87. At its locking end part 86, at a predetermined distance from the coupling end part 87, each link arm is provided with a cylindrical sleeve with a horizontal aperture to receive the shaft 24 and a lever-like press part 36 that protrudes into the rearward extension of the link arms.

Furthermore, each link arm 26, 27 is provided at its locking end part 86 with a counter-support 39, shaped with said functional, flat support surface 40, arranged to abut said functional support surface 18, 19 of the counter-supports 16, 17 of the bucket attachment member with a wedge-producing action. Said functional support surfaces 18, 19 and 40 incline towards the hooks 4, 5 and have the same inclination. The support surfaces 18, 19 and 40 of the counter-supports preferably slope so that their extended planes form an acute angle of from 20° to 65°, preferably about 40°, with a centre plane extending through the centre of the shafts 23, 24. The counter-support 39 is arranged immediately below said sleeves.

Each link arm 26, 27 is also provided or constructed at its coupling end part 87 with a shaft carrying sleeve 88 having a horizontal aperture for receipt of the shaft 23. The sleeve 88 is cylindrical and provided externally with a functional, semi-cylindrical support surface 89 extending transversely or axially (in relation to the shaft 23), and having a predetermined radius corresponding to the radius of the semi-circular support surfaces 9 on the hooks 4, 5, so that maximum contact is achieved between these support surfaces. The support surfaces 9 of the hooks encompass a sector angle within the interval 45°–180°.

Figure 6:
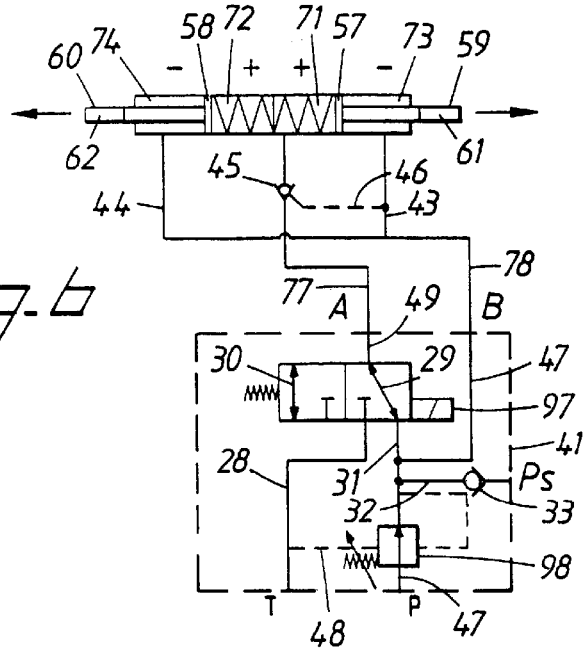
FIG. 6 is a circuit diagram for the locking member according to FIG. 4 and its control unit.
Figure 2:
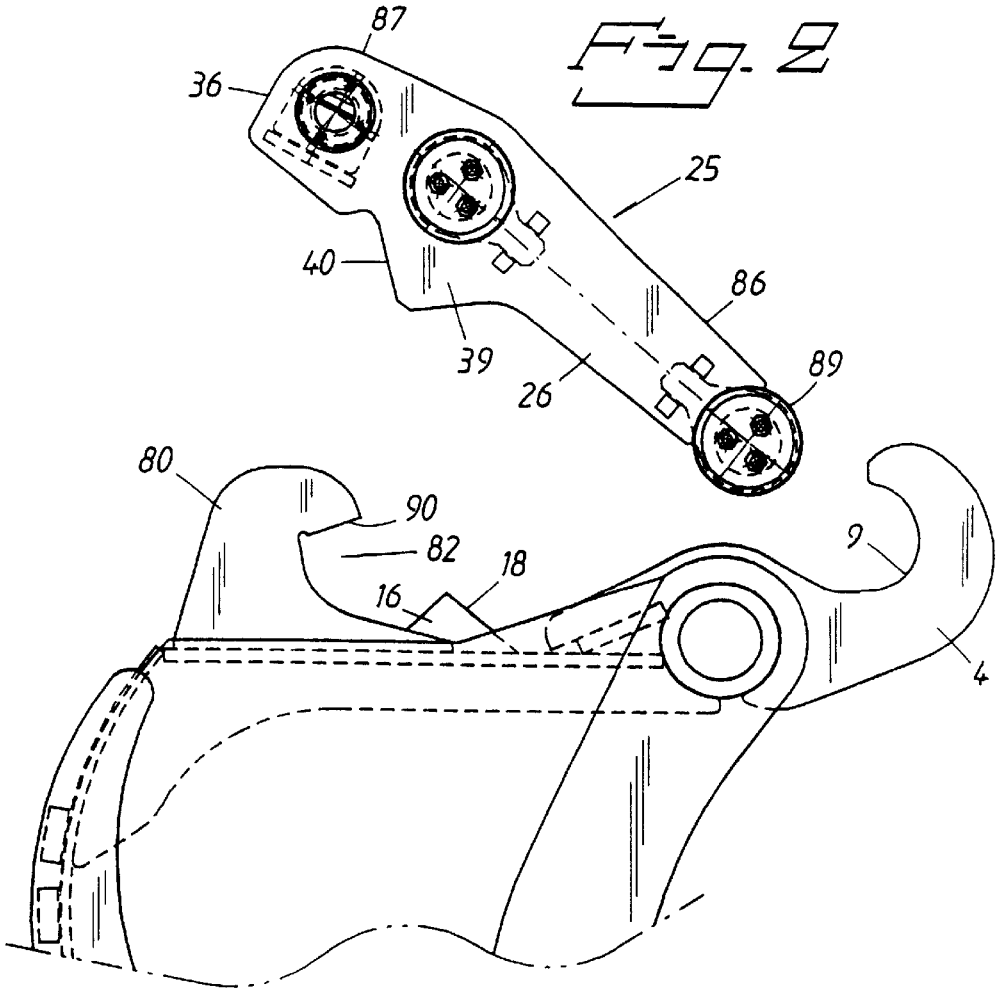
FIG. 2 shows a coupling device from the side.
Figure 7:
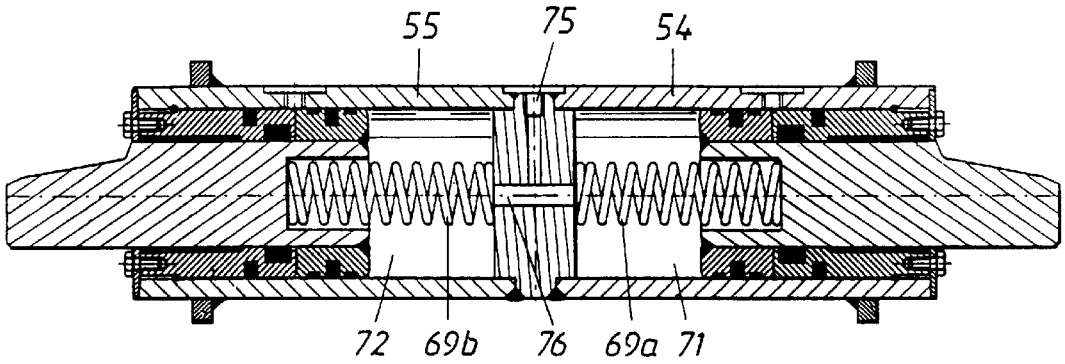
FIG. 7 shows a section through a second embodiment of the hydraulic locking member according to the invention.

The attachment member 25 of the operating arm comprises a locking member 50 in the form of a cassette or ancillary device that enables simple and quick mounting in both new and existing quick-couplings. The locking member 50 comprises a hydraulic cylinder 51 containing two coaxial piston rods 52, 53 arranged in one part each of the hydraulic cylinder to press the parts out and in via their opposite ends from an inner, pressed-in, inoperative position protected from external influence to an outer, operative position pressed out of the respective parts. The hydraulic cylinder 51 may be constructed as a single pipe. However, for ease of manufacture it is constructed of two identical cylindrical pipe sections 54, 55, the facing ends of which are welded to a central body 56 as shown in FIGS. 4 and 7 (omitted in FIG. 6). Each piston rod 52, 53 is provided at its inner end part with a piston 57, 58 and has an outer end part shaped to function as a locking wedge 59, 60. The locking wedge has a flat surface 61 inclining outwardly towards the centre plane of the piston rod. The most preferred inclination is 10°. The piston rod runs in a sealed guide 63, 64 situated in the pipe sections 54, 55 to sealingly close this, and is retained in the pipe section by means of an end lid 65, 66 screwed firmly on. The inner end part of the piston rods 52, 53 is provided with a coaxial cylindrical recess 67, 68 to receive the end of a compression spring 69. In the embodiment shown in FIGS. 2–5 a single spring 69 is used which is tensioned between the two piston rods 52, 53 which thus receive one end each of the spring. The spring thus extends through a coaxial cavity 70 in the central body 56. In the embodiment shown in FIG. 7 two springs 69*a*, 69*b* are used, which are tensioned between the central body 56 and the piston rods 52, 53, respectively.

Figure 3:
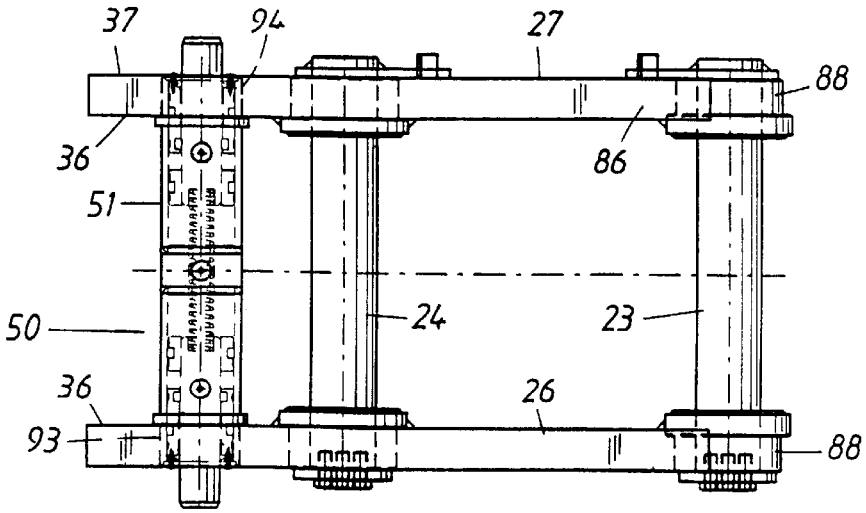
FIG. 3 shows from above the operating-arm attachment member of the coupling device according to FIG. 2.
Figure 4:
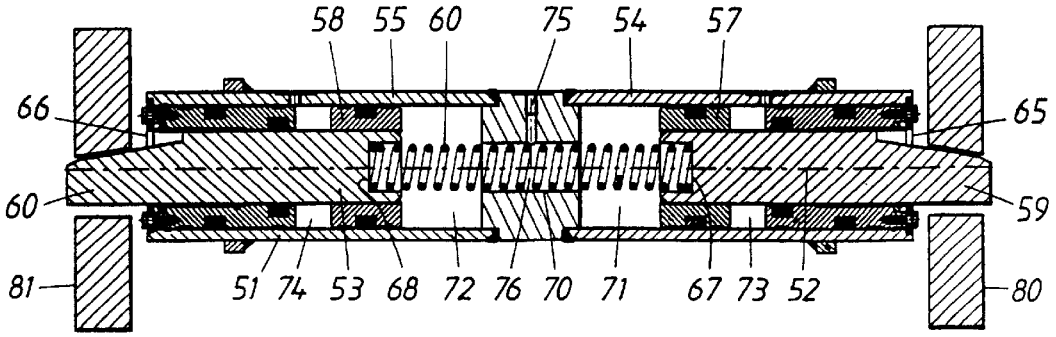
FIG. 4 shows in section a first embodiment of the hydraulic locking member of the coupling device according to FIG. 2 in operative, locking state.
Figure 5:
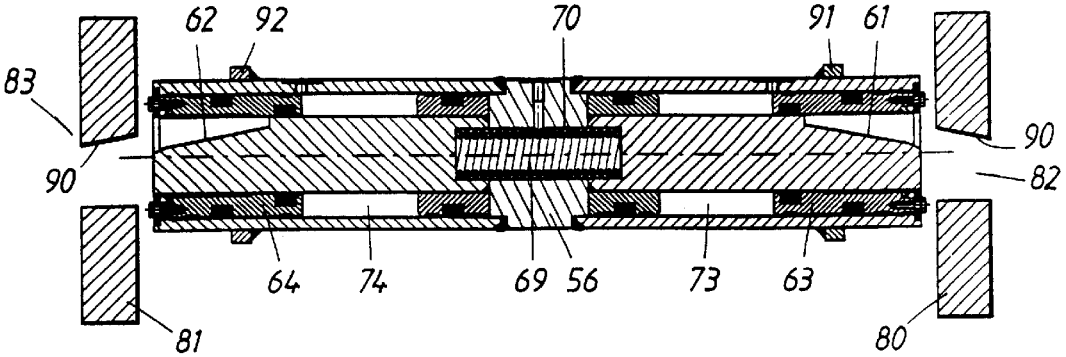
FIG. 5 shows the locking member according to FIG. 4 in inoperative, opened state.

The compression spring 69 in the embodiment shown in FIGS. 3–5 is arranged to pre-stress the piston rods 52, 53 in their outer locking positions so that these locking positions will always be ensured in the event of faults occurring in the hydraulic system during operation. In the embodiment shown in FIG. 7 the two compression springs 69*a*, 69*b* are arranged to pre-stress the piston rods 52 and 53, respectively, in corresponding manner.

Each piston 57, 58 defines a first pressure chamber 71, 72 between itself and the central body 56, forming the plus side for activation of the locking wedges 59, 60. Each piston defines a second pressure chamber 73, 74 between itself and the piston-rod guides 63, 64, forming the minus side for de-activation of the locking wedges 59, 60. As can be seen in FIGS. 4 and 5, for instance, the pressure area is considerably larger on the plus side than on the minus side.

In the described embodiment of the quick-coupling the compressive force is transferred from the locking wedges 59, 60 to the hooks 4, 5 via the counter-supports 39, the link arms 26, 27 and their sleeves 88, which press directly against the hooks 4, 5 and the shaft 23 is therefore not affected by this compressive load. At the stresses arising due to movement of the bucket with the aid of the operating arm, therefore, compressive forces appear on the exterior 89 of the sleeves 88, i.e. the support surfaces towards or away from the support surfaces 9 of the hooks, and on the interior of the sleeves towards or away from the shaft 23. The joint is completely rigid at the support surfaces 9 of the hooks 4, 5.

The locking member 50 comprises a control unit 41 which includes a valve block located at a suitable point on the excavator and coupled to the hydraulic system of the excavator. The hydraulic system may have a servo-pressure source or a system pressure source. The servo-pressure source is low-pressure acting, e.g. 50 bar, and can therefore be used without reduction, whereas the system pressure source is high-pressure acting and requires pressure reduction upon connection to the hydraulic cylinder. The control units shown in FIGS. 6 and 9, 10 can be connected to either type of pressure source. The control units shown have a gate P for connection to the system pressure source if the excavator lacks a servo-pressure system, and a gate Ps for connection to the servo-pressure system if the excavator is provided with a servo-pressure system.

A gate T is provided for connection to a drainage tank when the locking member is to be detached from the work implement. The control unit 41 also has a gate A for connection to the two pressure chambers 71, 72 of the hydraulic cylinder on the plus side of the pistons 57, 58 via a hose 77 and a T-shaped connection 42 in the intermediate piece 56, which connection 42 is formed by a radial channel 75 and an axial channel 76. The control unit 41 is also provided with a gate B for connection to the two pressure chambers 73, 74 of the hydraulic cylinders on the minus side of the pistons 57, 58 via a hose 78 and two branch connections 43, 44, which branch connections are suitably surrounded by a casing or other protective element to prevent them being damaged. In the flow path formed by the hose 77 and the T-shaped connection 42 is a pilot-controlled non-return valve 45 which is also connected via a connection 46 to the flow path formed by the hose 78 and one of the branch connections 43, 44. The control unit 41 comprises a pressure-reducing valve 98 arranged in the valve block, which can be pre-set at a desired lower pressure, e.g. 50 bar, and a directional valve 97. A channel 47 connects gate P to gate B, in which channel 47 the pressure-reducing valve 98 is arranged in order to emit a simulated servo-pressure upon locking and opening of the hydraulic locking member 50 when the excavator is not equipped with a servo-pressure system. The pressure-reducing valve 98 thus reduces the incoming system pressure at gate P to the pre-set value and the remaining oil is thus diverted to the drainage tank via a drainage channel 48 and gate T. The directional valve 97 is connected to gate A via a channel 49 and with gate T via a drainage channel 28, to which the drainage channel 48 of the pressure-reducing valve 98 is connected. The directional valve 97 is also connected to gate P via a channel 31 which is connected to channel 47 at a point downstream of the pressure-reducing valve 98. A channel 32 from gate Ps is also connected at the same point, which channel 32 is provided with a non-return valve 33. The directional valve 97 has a first closable passage 29 and a second closable passage 30. In non-activated state of the directional valve 97 its first passage 29 opens a flow path between gate P and gate A in order to set the locking member 50 in locking function, and this flow path is maintained continuously so that the locking member 50 producing a wedge action becomes self-adjusting when wear occurs on the wedge surfaces and other contact surfaces of the two attachment members 20, 25. In activated state of the directional valve 97 its other passage 30 opens a flow path between gate A and gate T in order to set the locking member 50 in opening function by allowing oil to flow from the pressure chambers 71, 72 along this flow path via the T-shaped connection 42 and hose 77, whereupon the pilot-controlled non-return valve 45 is opened for drainage purposes of the pressure exerted on it via the connection 46 still communicating with gate P.

On the outer side of each end part of the hydraulic cylinder 51 a support ring 91, 92 is arranged at a predetermined distance from the outer end of each end part. The hydraulic cylinder 51 is mounted at the two link arms 26, 27 which are provided with opposing cylindrical openings 93, 94 in which the cylindrical pipe sections 54, 55 are received in a loose connection, i.e. without mechanically fixed connection between the actual link arms 26, 27 and the actual pipe sections 54, 55, in order to avoid built-in stresses in the operating-arm attachment member 25. No welding or screwing is performed, therefore, and the connection is quite loose and thus not rigid. The distance between the two support rings 91, 92 thus corresponds to the distance between the link arms 26, 27 which are to abut against the support rings 91, 92.

Figure 8:
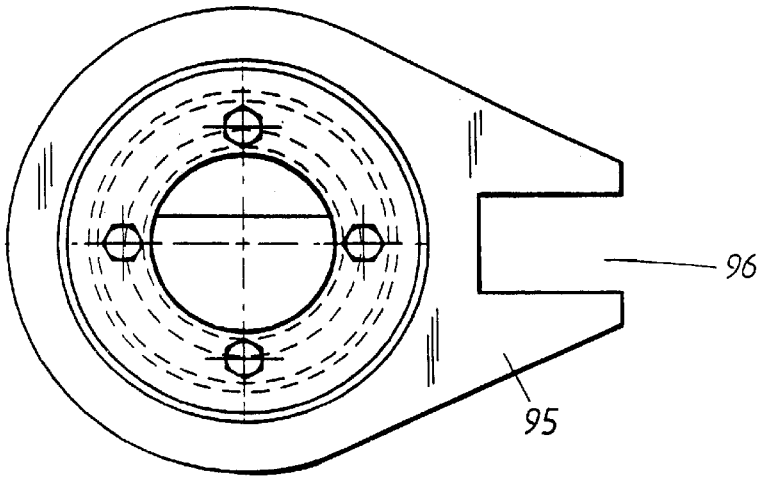
FIG. 8 shows an end view of the locking member according to FIG. 7.

As can be seen more clearly in FIG. 8, one support ring 91 is provided with a radial extension 95 with a slot 96 to receive a holding element (not shown), provided or applied on the inner side of the opposing link arm 26. Such stop members, i.e. at the position of the holder element in the slot 96, prevent the hydraulic cylinder 51 from turning, thereby ensuring that the positions in circumferential direction of the locking surfaces 61, 62 of the locking wedges 59, 60 are always maintained.

Said openings 82, 83 in the locking elements 80, 81 of the bucket attachment member 20 have wedge-forming surfaces 90 with the same inclination as the wedge surfaces 61, 62 on the piston rod. The wedge-forming surface is situated at the uppermost part of the opening. Upon hydraulic activation of the locking wedges 59, 60 to their protruding locking positions, their wedge surfaces 61, 62 are brought into contact with the wedge surfaces 90 of the locking elements 80, 81 so that a wedge joint is obtained, whereupon the forces thus obtained are transferred to the hooks 4, 5 via the link arms 26, 27 and the cooperating counter-supports 39, 16, 17 so that a rigid joint is obtained between the two attachment members 20, 25.

Each of the second pressure chambers 73, 74, i.e. on the minus side of the piston, are also placed under pressure when the piston rods 52, 53 are to be activated for movement to their locking positions. A retarding effect is achieved due to said difference in the areas on the plus and minus sides of the piston 57, 58, when the piston rod 52, 53 is pressed out, thereby avoiding unfavourably high locking action. In other words, a controlled locking action is achieved.

In the embodiments shown in FIGS. 1–7 the pilot-controlled non-return valve 45 is arranged outside the hydraulic cylinder 51, namely in the hose 77 and for reasons of safety this arrangement necessitates the arrangement of one or two compression springs 69 to pre-stress the locking wedges 59, 60 in their locking positions. In the embodiment according to FIGS. 9 and 10 the pilot-controlled non-return valve 45 is integrated with the hydraulic cylinder 51 and the flow path between the non-return valve 45 and pressure chambers 71, 72 is therefore well protected from external damage. The compressive spring arrangement is avoided in this case.

According to this latter embodiment the pilot-controlled non-return valve 45 is arranged in the intermediate piece 56, more specifically in the radial channel 75 of the T-shaped connection 42. The intermediate piece 56 is preferably provided with a radial extension 34 extending radially outside the pipe sections 54, 55 in order to house a part of the hose 77 and also the whole connection 46 connected to a special input on the non-return valve 45 to open the latter for drainage purposes when the pressure ceases in the hose 77 for the purpose of releasing the locking wedges 59, 60.

Figure 9:
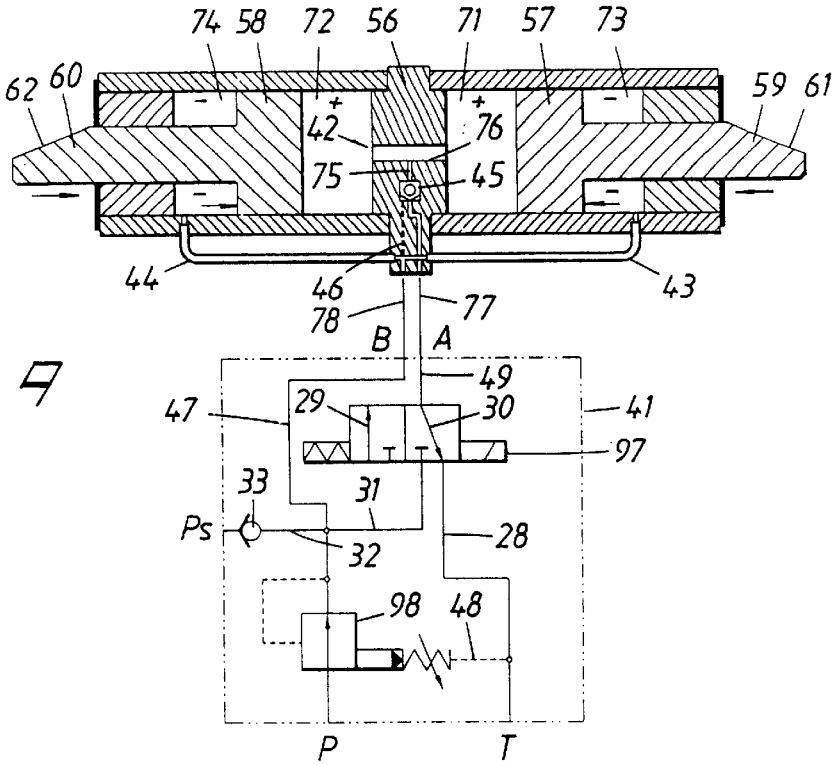
FIG. 9 shows a section through a third embodiment of the hydraulic locking member according to the invention, with its control unit set to open the locking member.
Figure 10:
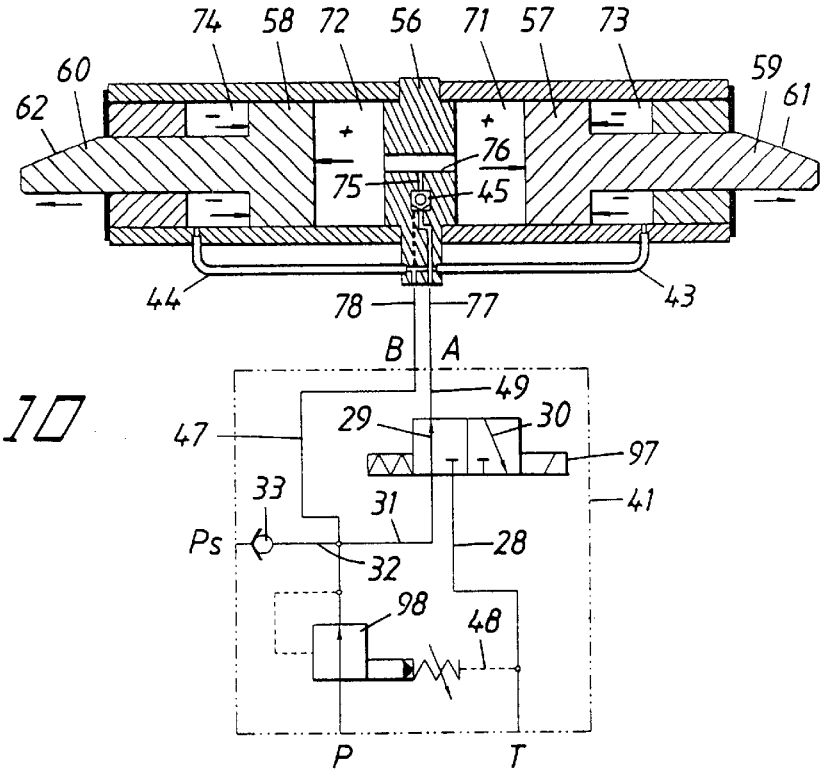
FIG. 10 shows the locking member and control unit in operative locking state.

The following is a description of the function of the locking member 50 with its control unit 41 connected to a system pressure source to obtain a simulated servo-pressure according to FIGS. 9 and 10.

Locking

When the system pressure is released through gate P, the oil first passes the pressure-reducing valve 98 which reduces the system pressure to the pre-set level, e.g. 50 bar, whereupon the remaining oil is drained to a tank via gate T. The oil then passes the electrically controlled directional valve 97 which, in non-activated position, is in locking function. In this position the control unit allows oil through both gate A and gate B thus pressurising the hydraulic cylinder on both sides of each piston 57, 58. A favourable retardation of the locking function is obtained due to the area ratio, and the locking member 50 does not lock with full force, but only sufficiently to achieve locking action. This is a desired result in order to eliminate excessive wedge effects between locking members and work implements of this type. The pressure for this locking function is constant in order to achieve a self-adjusting play-free function between cooperating contact surfaces of implement and attachment members 20, 25, including the wedge surfaces 61, 62, 90.

Opening

When the hydraulic locking member is to be opened, gate P is pressurized and the oil passes the pressure-reducing valve 98 which reduces the system pressure to the pre-set pressure, the remaining oil being drained to a tank via gate T. The directional valve 97 is activated and the incoming oil is conveyed through gate B and into the two minus connections of the hydraulic cylinder, and via the pilot-controlled non-return valve 45 fitted in the central body 56 of the hydraulic cylinder so that the oil in the plus chambers 71, 72 can be drained to a tank. The oil fills the two minus chambers 73, 74 and opens the locking member 50. This produces a force in the opening function which is approximately 50% greater than when the locking member is locked.

If the machine has a functioning servo-pressure system gate P may be plugged and the pressure hose connected to the servo-gate Ps of the control unit. The same effect is then achieved in the locking member.

What is claimed is:

1. A device for detachably coupling an implement to the operating arm of an excavator, comprising:

locking manifestations on said implement, including locking members with supporting surfaces, locking elements with locking surfaces, and counter supports between said locking members and locking elements;

a first shaft for receiving a stick for connecting an excavator operating arm to said implement so that said implement is pivotable about said first shaft;

said first shaft mounted by an attachment member comprising first and second substantially parallel link arms having first and second ends, said first shaft mounted adjacent said first ends of said link arms;

a second shaft substantially parallel to said first shaft and mounted by said link arms between said first and second ends thereof;

counter-supports provided on said link arms between said first and second ends thereof, and cooperating with said counter supports on said implement;

first and second openings formed in said first and second link arms, respectively, adjacent said second ends thereof;

a hydraulic locking member loosely mounted in said first and second openings, extending between said link arms, so that said locking member does not make locking engagement with said link arms, but said link arms prevent axial movement of said hydraulic locking member;

at least one stop acting between said hydraulic locking member and at least one of said link arms to prevent rotation of said locking member in said openings;

said hydraulic locking member comprising: a hydraulic cylinder; first and second piston each having a minus side and a plus side, said plus sides having effective pressure areas larger than said minus sides; a rear pressure chamber defined in said cylinder on said plus side of each of said pistons, and a forward pressure chamber defined in said cylinder on said minus side of each of said pistons; and first and second piston rods connected to said first and second pistons, respectively, and facing outwardly from each other, and each having a free end extendable outwardly from said cylinder, said free ends having locking wedge surfaces; and a hydraulic control unit which supplies hydraulic fluid to said forward chambers, and supplies hydraulic fluid to said rear chambers, with selectively variable pressure to move said piston rods from a first position, in which said locking wedge surfaces thereof extend outwardly from said link arms and engage said locking surfaces of said locking elements of said implement to lock said attachment member to said implement operatively engaging said locking member supporting surfaces, locking element locking surfaces, and counter supports, and a second position, in which said locking wedge surfaces are withdrawn to an extent that said locking wedge surfaces do not operatively engage said locking member supporting surfaces so that said attachment member is readily detached from said implement.

2. A device as recited in claim 1 wherein said hydraulic control unit comprises a pilot-controlled non-return valve which is connected to said forward chambers to substantially permit emptying of said forward chambers so that said piston rods move to said second position.

3. A device as recited in claim 2 wherein said hydraulic control unit further comprises a locking connection and an opening connection; and wherein said non-return valve is connected via a branch connection to said opening connection for supplying hydraulic fluid at operating pressure when said locking connection is disconnected.

4. A device as recited in claim 1 wherein said control unit substantially continuously supplies hydraulic fluid to said forward chambers even when supplying hydraulic fluid to said rear chambers with said piston rods in said first position, so as to provide a retarding effect on said piston rods and therefore providing a controlled locking action between said locking wedge surfaces and said locking surfaces of said locking elements of said implement.

5. A device as recited in claim 4 wherein said locking surfaces of said locking elements of said implement are inclined.

6. A device as recited in claim 5 wherein said piston rods have a direction of elongation, and wherein said locking surfaces of said locking elements of said implement, and said locking wedge surfaces, each have an angle of inclination of between about 9–11 degrees with respect to the direction of elongation of said piston rods, so that controlled wedge action is provided therebetween without auto-locking.

7. A device as recited in claim 1 wherein said locking surfaces of said locking elements of said implement are inclined.

8. A device as recited in claim 7 wherein said piston rods have a direction of elongation, and wherein said locking surfaces of said locking elements of said implement, and said locking wedge surfaces, each have an angle of inclination of about 10 degrees with respect to the direction of elongation of said piston rods, so that controlled wedge action is provided therebetween without auto-locking.

9. A device as recited in claim 1 wherein said hydraulic locking member is loosely mounted in said first and second openings, extending between said link arms, so that said locking member does not make locking engagement with said link arms, but said link arms prevent axial movement of said hydraulic locking member, by supports connected to an outer surface of said cylinder and spaced from each other a distance substantially equal to the spacing between said link arms, said supports engaging surfaces of said link arms facing each other.

10. A device as recited in claim 1 further comprising at least one spring mounted within said cylinder for biasing said piston rods to said first position.

11. A device as recited in claim 10 wherein said at least one spring comprises a single spring engaging both of said pistons within said rear chamber.

12. A device as recited in claim 10 wherein said cylinder includes a central body between said rear chambers, and wherein said at least one spring comprises first and second springs each acting between said body and one of said pistons.

13. A device as recited in claim 2 further comprising a transverse central body mounted in said cylinder to define and separate said rear chambers, said body having a R-passage therein including a radial channel and an axial channel connecting said rear chambers; and wherein said pilot-controlled non-return valve is disposed in said radial channel.

14. A device as recited in claim 1 wherein said locking members of said implement comprise two locking members, and wherein said supporting surfaces comprise two concave or semi-circular surfaces which are engages by semi-circular support surfaces extending outwardly from said first ends of said first and second link arms.

15. A device as recited in claim 14 wherein said counter supports of said implement comprise two counter supports, each having a surface cooperating with said link arm counter-supports making an angle of between about 20–65 degrees with respect to a center plane extending through the centers of said first and second shafts.

16. A device as recited in claim 15 wherein said piston rods have a direction of elongation; and wherein said locking elements of said implement comprise two locking elements, and wherein said locking surfaces of said locking elements and said locking wedge surfaces have cooperating angles of inclination with respect to the direction of elongation of said piston rods.

17. An attachment device for detachably coupling an implement to the operating arm of an excavator, comprising:

a first shaft for receiving a stick for connecting an excavator operating arm to an implement so that the implement is pivotable about said first shaft;

first and second substantially parallel link arms for mounting said first shaft, said arms each having first and second ends, said first shaft mounted adjacent said first ends of said link arms;

a second shaft substantially parallel to said first shaft and mounted by said link arms between said first and second ends thereof;

a counter-supports provided on each of said link arms between said first and second ends thereof, and each having a surface making an angle of between about 20–65 degrees with respect to a center plane extending through the centers of said first and second shafts;

first and second openings formed in said first and second link arms, respectively, adjacent said second ends thereof;

a hydraulic locking member loosely mounted in said first and second openings, extending between said link arms, so that said locking member does not make locking engagement with said link arms, but said link arms prevent axial movement of said hydraulic locking member;

at least one stop acting between said hydraulic locking member and at least one of said link arms to prevent rotation of said locking member in said openings; and said hydraulic locking member comprising: a hydraulic cylinder; first and second piston each having a minus side and a plus side, said plus sides having effective pressure areas larger than said minus sides; a rear pressure chamber defined in said cylinder on said plus side of each of said pistons, and a forward pressure chamber defined in said cylinder on said minus side of each of said pistons; and first and second piston rods connected to said first and second pistons, respectively, and facing outwardly from each other, and each having a free end extendable outwardly from said cylinder, said free ends having locking wedge surfaces.

18. An attachment as recited in claim 17 wherein said piston rods have a direction of elongation, and wherein said locking wedge surfaces each have an angle of inclination of between about 9–11 degrees with respect to the direction of elongation of said piston rods.

19. An attachment as recited in claim 17 wherein said hydraulic locking member is loosely mounted in said first and second openings, extending between said link arms, so that said locking member does not make locking engagement with said link arms, but said link arms prevent axial movement of said hydraulic locking member, by supports connected to an outer surface of said cylinder and spaced from each other a distance substantially equal to the spacing between said link arms, said supports engaging surfaces of said link arms facing each other.

20. An attachment as recited in claim 17 further comprising at least one spring mounted within said cylinder for biasing said piston rods to said first position.

* * * * *